United States Patent [19]

Holloway

[11] 4,189,933

[45] Feb. 26, 1980

[54] HAND OPERATED LOCKBOLT SETTING TOOL

[75] Inventor: David J. Holloway, Aldridge, England

[73] Assignee: USM Corporation, Farmington, Conn.

[21] Appl. No.: 944,711

[22] Filed: Sep. 22, 1978

[51] Int. Cl.[2] ..... B21J 15/34

[52] U.S. Cl. ..... 72/391; 72/452; 81/313

[58] Field of Search ..... 72/391, 114, 452; 81/313, 393

[56] References Cited

U.S. PATENT DOCUMENTS

| | | | |
|---|---|---|---|
| 2,150,361 | 3/1939 | Chobert | 72/391 |
| 2,965,258 | 12/1960 | Wilson | 72/391 |
| 3,033,410 | 5/1962 | Hanneman | 72/391 |
| 3,359,779 | 12/1967 | Filia | 72/452 |

FOREIGN PATENT DOCUMENTS

| | | | |
|---|---|---|---|
| 113538 | 7/1941 | Australia | 72/391 |
| 741414 | 12/1932 | France | 72/391 |
| 102715 | 8/1963 | Norway | 72/391 |

*Primary Examiner*—Francis S. Husar
*Assistant Examiner*—Gene P. Crosby
*Attorney, Agent, or Firm*—Aubrey C. Brine; Richard B. Megley; Vincent A. White

[57] ABSTRACT

A pull-type fastener setting tool is provided comprising a pistol-shaped housing having an abutment on a barrel portion for engagement with one part of a fastener and which also includes a hand-grip portion, a pulling device slidable in the housing and engageable with a pulling stem of the fastener, a rotatable handle mounted on the housing, and actuating means including a plate cam arranged to be rotated by means of the handle. The actuating means also includes a cam follower mounted on an arm pivoted on the pulling device, the arm being connected by a link which is pivoted at one end to the arm and at the other end to the housing at a remote part of the hand-grip portion. The cam follower is capable of reciprocating along an arc of large radius in response to turning of the handle without moving significantly out of alignment with the pulling device.

8 Claims, 3 Drawing Figures

HAND OPERATED LOCKBOLT SETTING TOOL

BACKGROUND OF THE INVENTION

This invention is concerned with improvements in or relating to fastener-setting tools, especially of the kind used for setting pull-type fasteners.

Pull-type fasteners are those which require, to set them, a tool which will engage a pulling stem of the fastener, for example, a pin or mandrel, while holding stationary another part of the fastener, a rivet or collar, by engagement of an anvil of the tool. Such tools are commonly used in blind riveting and setting lockbolts.

A tool which is known for setting lockbolts comprises a housing having a configuration resembling that of a pistol, with a barrel portion and a hand-grip, an anvil mounted on the barrel portion, a pulling device slidably mounted in the barrel portion and in a bearing at the rear of the housing and arranged to engage the pulling stem of the bolt, and a handle rotatably mounted on the housing and coupled by gearing to a rotatable cam plate by which the pulling device can be reciprocated.

It is desirable that a hand-operated tool for setting pull-type fasteners shall be as light in weight and as cheap to produce as is compatible with robustness to withstand wear and tear in use and the development of adequate pulling force within the capability of the operator.

It, therefore, is one of the various objects of the present invention to provide an improved tool for setting pull-type fasteners which is of lighter and cheaper construction than the known one hereinbefore referred to.

SUMMARY OF THE INVENTION

A tool for use in setting pull-type fasteners, such as lockbolts, is hereinafter described in detail to illustrate the invention by way of example, this illustrative tool comprising a housing in the general shape of a pistol, having a barrel portion which provides an abutment for engagement with a collar of the lockbolt and a hand grip portion, and a pulling device slidable in the barrel portion of the housing and having jaws to engage a pulling stem of the lockbolt. The illustrative tool also comprises actuating means to reciprocate the pulling device, such means including a rotary plate cam and an arm which carries a cam follower engaged by a peripheral face of the cam. The arm is pivoted to the pulling device so that rotation of the cam causes the cam follower to retract the pulling device; a second peripheral face of the cam is arranged to engage a shoulder on the arm to advance the pulling device in a return stroke of the tool. To control the arm so that the cam follower will follow an arc of large radius and not move significantly out of alignment with the pulling device as they reciprocate in response to rotation of the cam, a link is pivoted at one end to the arm and at the other to a remote part of the hand-grip portion of the tool, the link being sufficiently long for its upper end to rise and fall only slightly as it swings within the housing.

A handle is rotatably mounted on the housing of the illustrative tool and connected to the cam by gear wheels so that the pulling device will reciprocate in response to rotation of the handle by the operator.

The arm and link of the illustrative tool enable the tool to be constructed more cheaply and involve less weight of metal than is the case where the pulling device itself is extended rearwardly and supported by a bearing at the rear of the housing.

Although the illustrative tool is intended for use in setting lockbolts, it can also be used for setting pull-type blind rivets, in which case the tool could be modified by omission of the second cam face of the actuating means and by the introduction of a spring to return the pulling device to its foremost position, after a rivet-setting stroke.

The invention provides, in one of its several aspects, a pull-type fastener-setting tool comprising a pistol-shaped housing which provides an abutment on a barrel portion for engagement with one part of a fastener and which also includes a hand-grip portion, a pulling device slidable in the housing and engageable with a pulling stem of the fastener, a rotatable handle mounted on the housing, and actuating means including a plate cam arranged to be rotated by means of the handle, the actuating means also including a cam follower mounted on an arm pivoted to the pulling device, the arm being connected by a link which is pivoted at one end to the arm and at the other to the housing at a remote part of the hand-grip portion whereby the cam follower can reciprocate along an arc of large radius in response to turning of the handle without moving significantly out of alignment with the pulling device.

BRIEF DESCRIPTION OF THE DRAWING

The above and other of the various objects and several features of the invention will become more clear from the following description, to be read with reference to the accompanying drawing, of the illustrative fastener-setting tool hereinbefore referred to. It will be appreciated that this illustrative tool has been selected for description of the invention by way of example and not of limitation thereof.

In the accompanying drawing.

DESCRIPTION OF THE PREFERRED EMBODMENT

Figure 1:
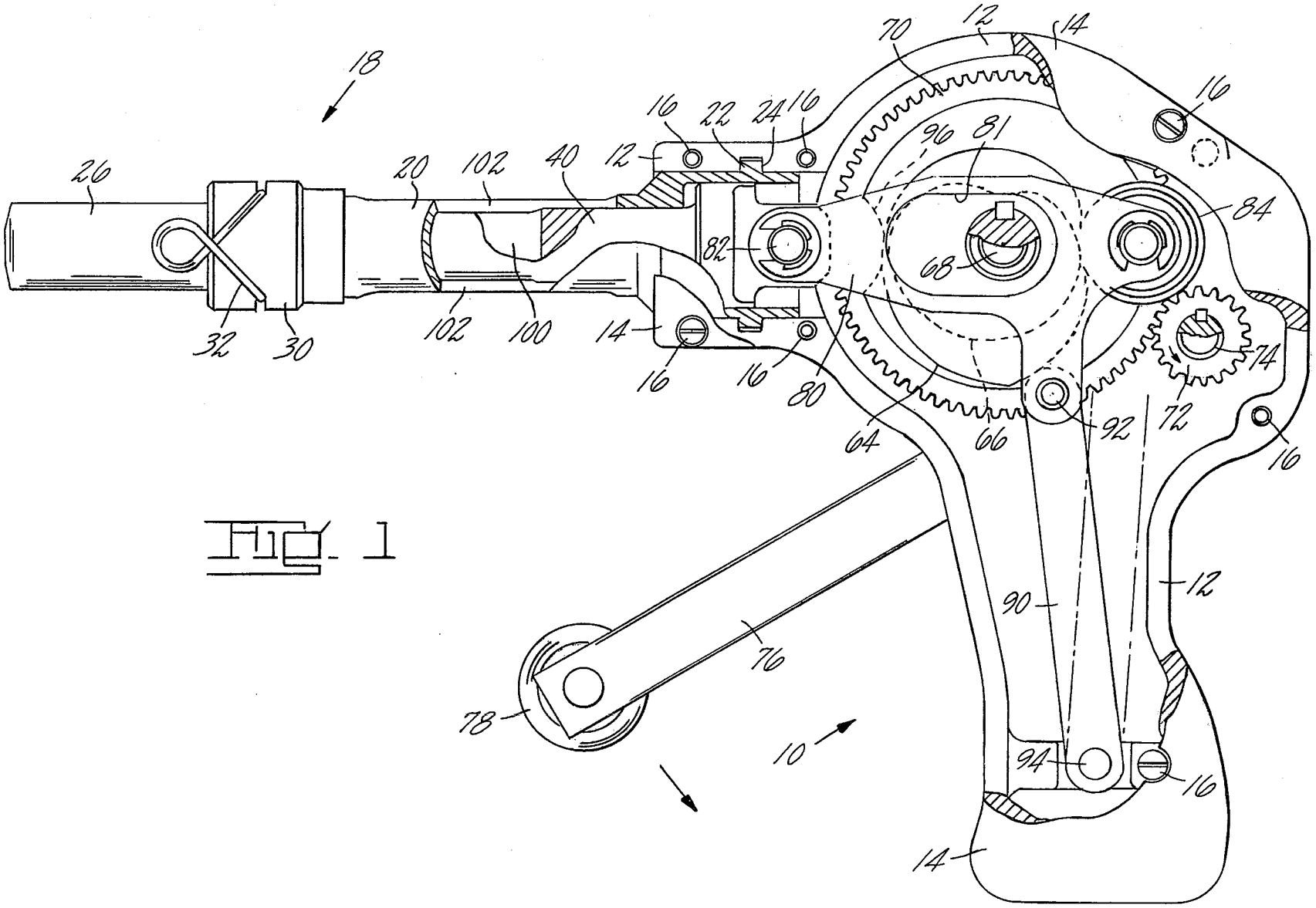
FIG. 1 is a view in elevation and partly in section of the illustrative fastener-setting tool.
Figure 3:
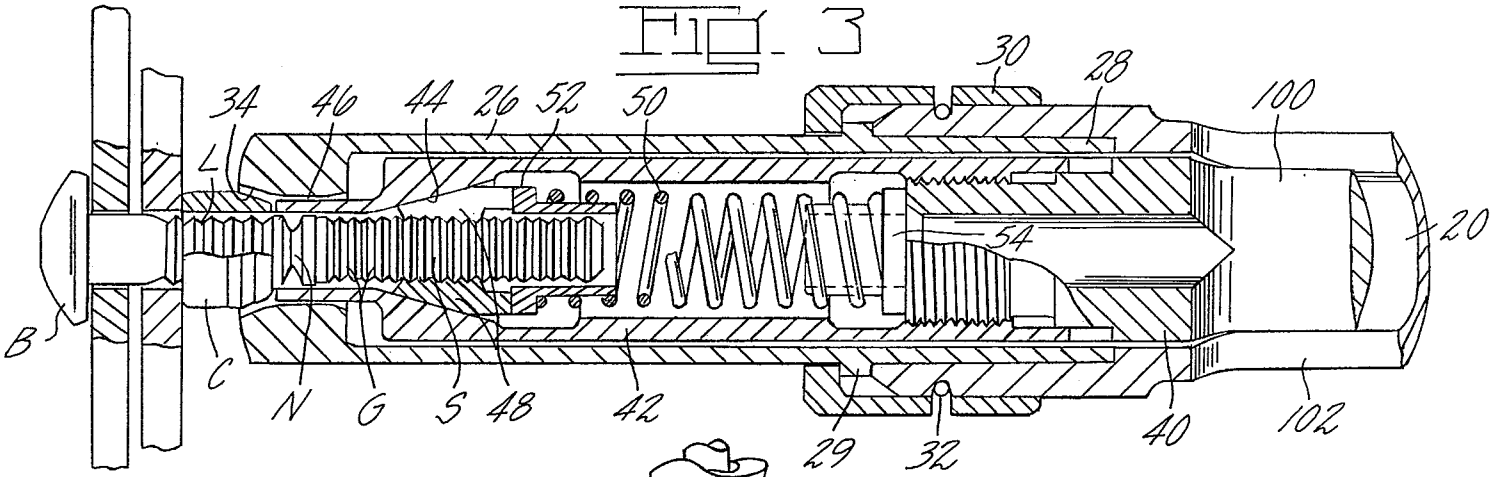
FIG. 3 is a view in longitudinal section of a nosepiece portion of the illustrative tool, shown on a larger scale than in FIG. 2.

As shown in FIG. 1, the illustrative fastener-setting tool comprises a fabricated hollow housing which is generally pistol-shaped and has a hand grip portion 10 provided by abutting castings 12,14 bolted together by fasteners 16 and a barrel portion 18, a part 20 of which is secured to the castings by an annular flange 22 accommodated in grooves 24 of the castings. A nosepiece portion 26 is detachably mounted on the part 20. For this purpose, as shown in FIG. 3, a cylindrical rear part 28 of the nosepiece portion 26 is mounted in a bore at the front of the part 20, an annular flange 29 abutting the front end of the part 20, and being held there by a collar 30 and retaining spring 32. The nosepiece portion 26 provides, at its front end, an anvil 34 of the illustrative tool for engagement with a collar C of a lockbolt, which also comprises a bolt B having a pulling stem S.

Mounted to slide axially in the barrel portion 20,26 of the illustrative tool is a pulling device comprising a plunger 40 to which is threaded at its forward end a jaw case 42 which, at its front end, has an internal frustoconical surface 44 and a cylindrical extension 46 accommodated within the anvil 34 provided by the nosepiece portion 26. Three jaws 48, only two of which are visible in FIG. 3, engage the surface 44 and are urged forwardly by a spring 50 contained between two flanged sleeves 52,54. The sleeve 52 abuts the jaws 48, while the sleeve 54 abuts the front end of the plunger 40. The jaws 48 are provided with teeth complementary in shape to radial grooves G on the pulling stem S. The arrangment is such as to permit ready replacement of the nosepiece portion 26, together with the jaw case, jaws and spring by similar parts for use with a different size of lockbolt.

Rotatably mounted in bearings 60 in the castings 12,14 is a composite plate cam 62 having two peripheral cam faces 64,66 provided by plates keyed to a common spindle 68 which also carries a gear wheel 70. The wheel 70 is in mesh with a smaller wheel 72 keyed to a spindle 74 also mounted in bearings in the castings 12, 14 and to which is also fixed a handle 76. Rotation of the handle 76 by the operator engaging a knob 78 at the end of it, results in rotation of the plate cam 62 with considerable mechanical advantage.

An arm 80, consisting of two parallel plates, is pivoted at 82 to a rear end portion of the plunger 40 of the illustrative tool, and at its rear end carries a cam roll (i.e. a cam follower) 84 in operative alignment with the cam face 64 so that, upon rotation of the handle 74, the arm 80, plunger 40 and jaw case 42 will be retracted in an operative stroke of the tool to set a lockbolt by pulling the stem S and swaging the collar C into locking grooves L of the bolt B, which subsequently breaks at a neck N. To restrain undue swinging of the arm 80 about the pivot 82 and constrain the cam roll 84 to reciprocate along an arc of large radius without moving significantly out of alignment with the plunger 40, a link 90 is pivoted at 92 to the two plates of the arm 80, and at 94 to remote parts of the castings 12,14 at the base of the hand grip portion 10 of the housing.

Figure 2:
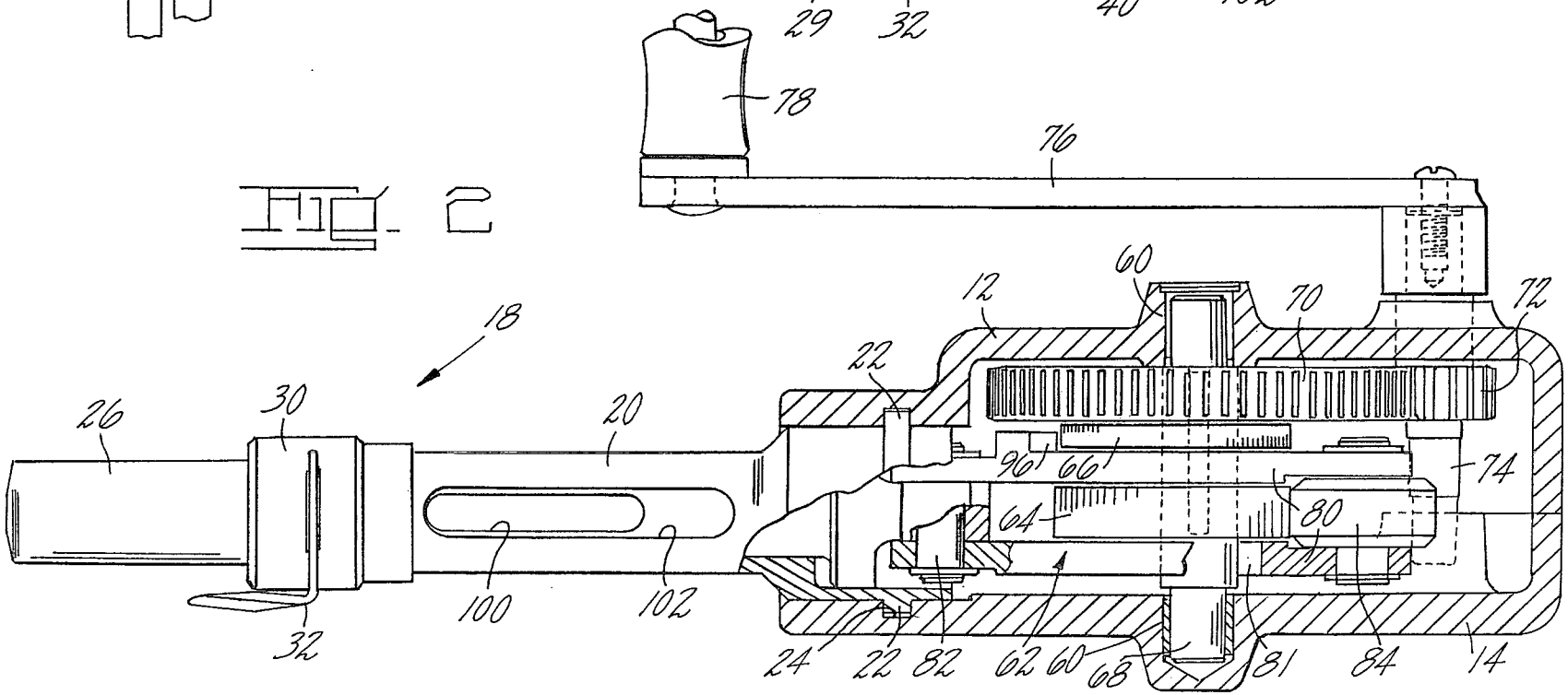
FIG. 2 is a plan view, partly in section, of the illustrative tool.

In operative alignment with the cam face 66 of the illustrative tool, in front of the spindle 68, is a shoulder 96 on one of the plates of the arm 80, as shown in FIGS. 1 and 2. As the handle 76 completes its revolution after setting a lockbolt, the plunger 40 and jaw case 42 are pushed forwards as a result of the cam face 66 bearing on the shoulder 80 so that the extension 46 of the jaw case pushes against the swaged collar and the anvil 34 is thus pulled off the collar.

The broken off stem of the lockbolt is retained by the jaws 48 during the forward return stroke of the jaw case 42 in the operation of the illustrative tool. Insertion of the next lockbolt through the extension 46 of the jaw case results in the broken off stem being pushed rearwardly, thus releasing itself from the jaws 48 and being projected through the sleeves 52 and 54, and out through slots 100, 102 in the plunger 40 and part 20 of the barrel portion 18 of the housing respectively. The jaws 48 then come into engagement with the stem S of the next lockbolt and the tool is ready for another fastener-setting operation.

I claim:

1. A pull-type fastener-setting tool comprising:

a housing having a barrel portion;

an abutment on said barrel portion for engagement with one part of a fastener;

pulling means slidable in said housing for engaging a pulling stem of the fastener;

actuating means including a cam rotatably mounted in said housing and a cam-follower mounted on an arm pivotably connected to said pulling means, and a link having one end thereof pivotably connected to said arm and the other end thereof pivotably connected to said housing at a point remote from said cam follower, whereby said cam follower reciprocates along an arc of substantially large radius without moving significantly out of aligment with said pulling means.

2. A pull-type fastener-setting tool as set forth in claim 1 which further includes a rotatable handle mounted on said housing and connected to said cam whereby said cam is rotated by rotation of said handle.

3. A pull-type fastener-setting tool as set forth in claim 1 wherein said housing is pistol-shaped having a hand grip portion extending angularly from said barrel portion.

4. A pull-type fastener-setting tool as set forth in claim 3 wherein said other end of said link is connected to said hand-grip portion of said housing near the end of said hand-grip portion opposite said barrel portion.

5. A pull-type fastener-setting tool as set forth in claim 4 which further includes a rotatable handle mounted on said housing and connected to said cam whereby said cam is rotated by rotation of said handle.

6. A tool for setting pull-type fasteners having a pull stem extending through a locking collar, comprising; a housing having the general shape of a pistol, said housing including a barrel portion having an abutment for engagement with the collar on said fastener, and a hand grip portion; pulling means slidable in said barrel portion and having jaws for engaging the pulling stem of said fastener, actuating means for reciprocating said pulling means and including a rotary cam, said actuating means further including a cam follower mounted on an arm and engaged by a first face of said cam; said arm being pivotably connected to said pulling means and having a shoulder formed thereon for engaging a second peripheral face of said cam, whereby rotation of said cam causes said cam follower to retract said pulling means and engagement of said shoulder with said cam causes said arm to advance said pulling means by rotation of said cam.

7. A tool as set forth in claim 6 which further includes a link pivotably connected at one end to said arm and at the opposite end to a remote surface of said hand grip portion whereby the rise and fall of said link is minimized during movement in said housing.

8. A tool as set forth in claim 7 which further includes a handle rotatably mounted on said housing and gear means connecting said handle to said cam whereby rotation of said handle is effective to rotate said cam and thereby reciprocate said pulling means.

* * * * *